US007097274B2

(12) United States Patent
Mantooth et al.

(10) Patent No.: US 7,097,274 B2
(45) Date of Patent: Aug. 29, 2006

(54) REMOVING GAS FROM A PRINTHEAD

(75) Inventors: Hal Mantooth, Vancouver, WA (US); Kit Harper, Vancouver, WA (US); Donald L. Michael, Monmoth, OR (US); Ian P. Anderson, Beaverton, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 277 days.

(21) Appl. No.: 10/769,422

(22) Filed: Jan. 30, 2004

(65) Prior Publication Data

US 2005/0168520 A1 Aug. 4, 2005

(51) Int. Cl.
*B41J 2/165* (2006.01)
*B41J 2/19* (2006.01)

(52) U.S. Cl. ..... 347/30; 347/92

(58) Field of Classification Search ..... 347/22–35, 347/92, 85–87

See application file for complete search history.

(56) References Cited

U.S. PATENT DOCUMENTS

| | | | | |
|---|---|---|---|---|
| 4,577,203 | A | 3/1986 | Kawamura | 347/30 |
| 5,812,155 | A | 9/1998 | Seccombe | 347/6 |
| 5,980,028 | A | 11/1999 | Seccombe | 347/85 |
| 6,164,752 | A | 12/2000 | Schaefer | 347/30 |
| 6,257,714 | B1 | 7/2001 | Seccombe | 347/92 |
| 6,364,471 | B1 | 4/2002 | Seccombe | 347/85 |
| 6,409,304 | B1 | 6/2002 | Taylor | 347/29 |
| 6,450,713 | B1 | 9/2002 | Parthasarathy et al. | 400/641 |
| 6,467,861 | B1 | 10/2002 | Thielman et al. | 347/6 |

FOREIGN PATENT DOCUMENTS

| | | |
|---|---|---|
| JP | 56075866 | 6/1981 |
| JP | 63224958 | 9/1988 |

*Primary Examiner*—Shih-Wen Hsieh

(57) ABSTRACT

A method of removing gas from a printhead is provided. A sealing material may be applied to orifices of a printhead from external the printhead to restrict passage of fluid through the orifices. Ink may be moved through a printhead conduit disposed in fluid communication with the orifices to create an inward suction adjacent the orifices so that the gas is displaced from adjacent the orifices.

17 Claims, 3 Drawing Sheets

REMOVING GAS FROM A PRINTHEAD

BACKGROUND

Printers may create printed output on a print medium by firing ink droplets at the print medium from nozzles of a printhead. To prepare the nozzles for firing initially, the nozzles are primed with ink, to replace gas with ink. The nozzles and their supply compartments then should be maintained relatively free of gas bubbles to maintain consistent firing of the nozzles.

DETAILED DESCRIPTION

The present teachings provide methods of removing gas from a printhead, and particularly from orifices (nozzles) and/or from firing compartments of the printhead disposed adjacent the orifices. A sealing material may be applied to the orifices from external the printhead to produce sealed orifices. The sealing material may separate internal gas inside the printhead from external gas outside the printhead and may restrict passage of fluid through the sealed orifices, such as passage of air and/or ink. The sealing material may be a solid sealant or a liquid sealant, such a viscous liquid, among others. In some embodiments, the sealing material may be a glycol. The sealing material may be configured to withstand a greater inwardly directed pressure than ink, while restricting entry of external gas through the orifices and into the printhead.

Ink may be moved through a printhead conduit disposed in fluid communication with the sealed orifices. The printhead conduit may operate as a venturi (a constricted tube) that so that ink movement may create a reduced pressure in the printhead conduit, according to Bernoulli's principle. The reduced pressure thus may provide an inwardly directly pressure drop (a net inward pressure or suction) between the sealed orifices and the printhead conduit, so that the ink (and/or the sealing material) displaces internal gas from adjacent the sealed orifices. The displacement of internal gas may effect (1) priming of the printhead with ink, and/or (2) servicing of the printhead to remove trapped gas from adjacent the sealed orifices (such as gas in the sealed orifices themselves and/or in firing compartments disposed adjacent the sealed orifices), among others.

Apparatus configured to remove gas from orifices and/or firing compartments of a printhead are also disclosed. The apparatus may include an inkjet printer. The apparatus also may include a service station with an applicator configured to apply a sealant to orifices of a printhead. The apparatus may include a pressure or flow controller configured to move ink through a conduit of the printhead, disposed between an ink supply chamber and a receiver compartment. The movement of ink may remove internal gas of the printhead from adjacent the orifices. The apparatus also may be configured to remove the sealant mechanically and/or by firing ink from the orifices into a spittoon, among others. The methods and apparatus disclosed herein may provide a more economical and/or effective approach to priming printheads and/or removing gas from the printheads. For example, the methods and apparatus disclosed herein may waste substantially less ink than a vacuum applied to the printhead orifices from external the printhead, which can suck substantial quantities of wasted ink from the printhead as the vacuum removes air.

Figure 1:
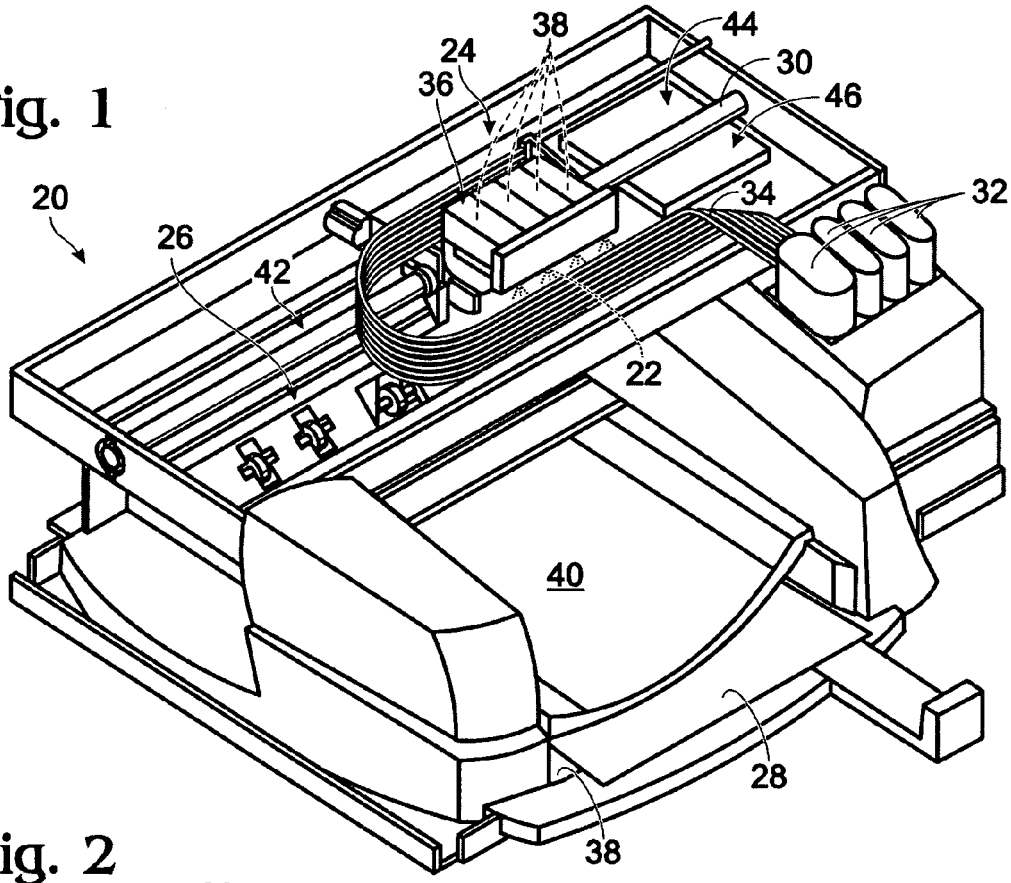
FIG. 1 is a view of an embodiment of a printer configured for removal of gas from printheads of the printer by application of a sealing material to the printheads, in accordance with the present teachings.

FIG. 1 shows an embodiment of a printer 20 configured for removal of gas from printheads 22 of the printer after application of a sealing material to the printheads. Printer 20 may be any suitable type of printer, such as an inkjet printer, among others. Printer 20 may include a colorant application assembly 24 and a media movement mechanism 26.

Gas, as used herein, may include air and/or any gas-phase substance or mixture disposed in or adjacent the printhead and/or the ink. Accordingly, gas may be introduced into an ink supply during packaging of the ink or fabrication of the printhead, may be evolved by chemical reaction in the ink, may escape from a dissolved condition or by evaporation, and/or may enter from an opening in the ink supply or printhead, such as air entering through an ink supply chamber, an ink reservoir, and/or a printhead nozzle, among others.

Colorant application assembly 24 may be configured to dispense one or more liquid colorants, hereafter termed ink, from printheads 22 to selected positions of a print medium 28, such as paper. Each printhead may include nozzles (orifices) and firing elements, such as heaters or piezoelectric elements, disposed adjacent the orifices. The printheads may be configured to reciprocate on carriage rod 30 to dispense swaths of ink to the selected positions of the print medium. The colorant application assembly may include a plurality of ink reservoirs 32 holding ink of different colors and in fluid communication with printheads 22. The ink reservoirs may be disposed adjacent the printheads as part of a cartridge and movable on the carriage rod during printhead scanning along a scan axis, for on-axis supply of ink. Alternatively, as shown in the present illustration, the ink reservoirs may be spaced from the printheads, for example, connected thereto using supply tubing 34. Accordingly, the ink reservoirs 32 may be stationary as the printheads reciprocate on carriage rod 30.

In the off-axis configuration shown in the present illustration, printheads 22 may be included in a printhead arrangement 36 including ink supply chambers 38. Each supply chamber may receive ink for its respective printhead from a corresponding ink reservoir 32 using supply tubing 34.

Media movement mechanism 26 may be configured to move a print medium before, during, and/or after colorant application assembly 24 dispenses ink onto the print medium. The media movement mechanism may define a path of media travel, from an input site 38 to an output site 40, that is disposed orthogonally to a scan axis along which the printheads reciprocate. The printheads may be configured to reciprocate in a print zone 42 adjacent the print medium for dispensing ink to the print medium. The printheads also may travel to a service zone 44 separate from, or overlapping, the print zone and including a service station 46, as described in more detail below.

Figure 2:
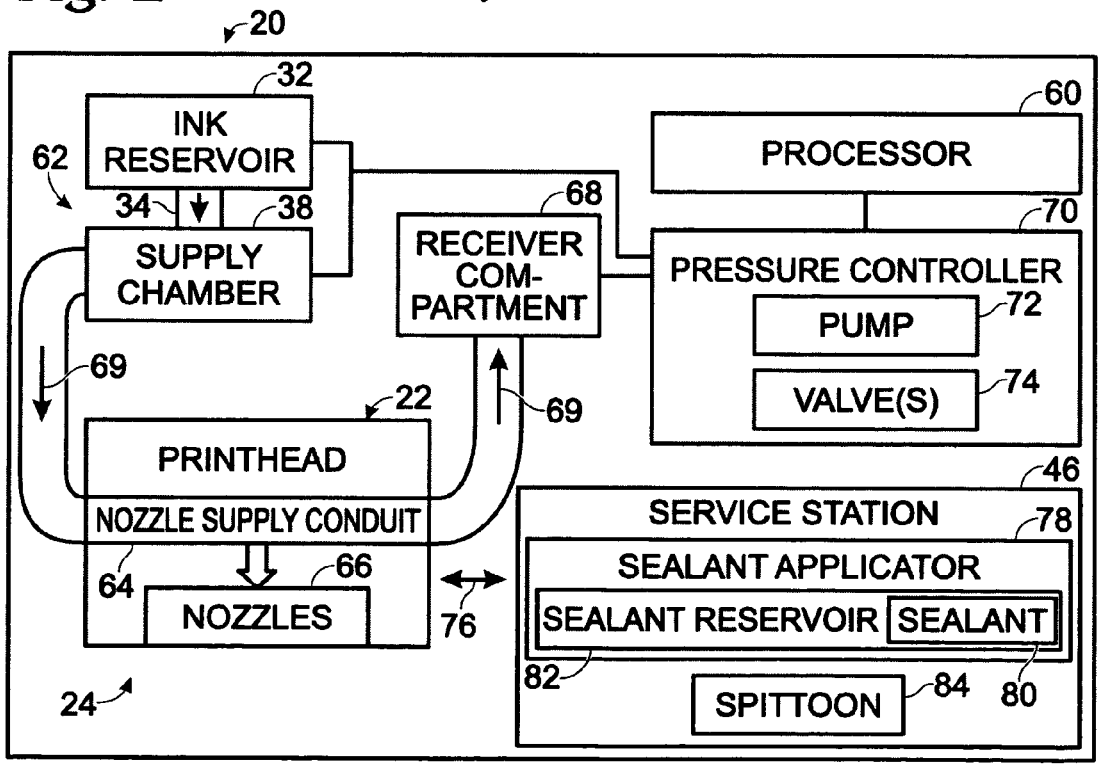
FIG. 2 is a schematic view of the printer of FIG. 1, in accordance with the present teachings.

FIG. 2 shows a schematic representation of selected aspects of printer 20. Printer 20 may include colorant application mechanism 24, a service station 46 for servicing aspects of the colorant application mechanism, and a processor 60 for controlling operation of the colorant application mechanism and/or service station.

Colorant application mechanism 24 may be configured to move ink between one or more ink reservoirs 32 and one or more printheads 22. To simplify the presentation, a single ink reservoir and printhead are shown in the present illustration. The ink reservoir may supply ink to a printhead assembly 62 through channel 34. The ink may travel into supply chamber 38 of printhead assembly 62, to nozzle supply conduit 64, and then out nozzles (orifices) 66. Alternatively, nozzles 66 may be sealed so that ink travels through nozzle supply conduit, past nozzles 66, and to receiver compartment 68, as indicated by the arrows shown at 69 (or in reverse, from receiver compartment 68 to supply chamber 38, among others). A printhead assembly, as used herein, is a printhead and any attached ink compartment(s), such as a supply chamber and/or receiver compartment, among others. A printer may include a plurality of printhead assemblies, termed a printhead arrangement.

Colorant application mechanism 24 may include at least one pressure or flow controller 70 to control fluid movement within the colorant application mechanism. The pressure controller may include a pump 72 (or pumps). The pump may be any mechanism for exerting a pressure on ink directly, or on a container holding ink, including pressurized gas, a vacuum pump, a mechanical pump (syringe, rotary, peristaltic, etc.), and/or the like. The pressure controller also or alternatively may include one or more valves 74 operable to permit or restrict fluid movement between ink compartments.

Service station 46 may be any portion of the printer configured to service printhead 22. The service station may be substantially stationary, so that the printhead is moved to the service station, the service station may move to the printhead, or a combination thereof, as indicated at 76. Service station 46 may include a nozzle sealant applicator 78 configured to apply a sealant 80 to the printhead from sealant reservoir 82. Service station 46 also may include a waste reservoir or spittoon 84 to receive ink and/or sealant from the printhead, particularly ink and/or sealant ejected from the printhead by actuation of firing elements of the printhead.

The sealant or sealing material may be solid, liquid, a combination thereof (such as a gel), among others. A solid sealing material may include a resilient member, such as formed of plastic or rubber, that is pushed against the printhead to create a seal. A liquid sealing material may be any suitable liquid. Exemplary liquid sealing materials are viscous. Viscous, as used herein, means having a greater viscosity than the viscosity of ink in the printhead. In some examples, the viscosity may be about 2 to 250 centipoise. Alternatively, or in addition, the sealing material may have a burst pressure greater than the burst pressure of ink in the printhead. The "burst pressure" for a fluid, as used herein, is the pressure at which the fluid's sealing capacity is lost, that is, the pressure at which a fluid sealing an orifice permits entry of external gas through the orifice. In some examples, a sealing material may be soluble in ink and may be miscible, that is soluble at any ratio of sealing material to ink. Exemplary sealing materials may be alcohols, particularly polyols or diols, such as glycols or polymers thereof.

Exemplary glycols or glycol polymers that may be suitable include dipropylene glycol, ethylene glycol, propylene glycol, and/or polyethylene glycol, among others.

The sealant applicator may be any mechanism for applying sealant 80 to the printhead. The form of the applicator may be in accordance with the type of sealant used. For example, with a solid sealant, the sealant applicator may be a structure or device for placing the solid sealant against the printhead, such as a cantilever or spring, among others. With a liquid sealant, the sealant applicator may be a structure that spreads the liquid sealant, such as a pad or brush, among others. Alternatively, or in addition, the sealant applicator may be a structure configured to spray the sealant on the printhead, to dip the printhead into the sealant, and/or the like.

Processor 60 may be any data-processing controller included in the printer or disposed in a separate apparatus, such as a computing device in communication with the printer. The processor may be configured to control operation of pump 72 and valve(s) 74, such as determining when and how much ink flows from ink reservoir 32 to printhead assembly 62. The processor also may be configured to control when and how much sealant 80 is applied to the printhead and to coordinate application of sealant and movement of ink through nozzle supply conduit 64. Accordingly, the processor may be coupled to a sensor that senses a property of ink from a subset or all of the nozzles. For example, the sensor may measure a property such as droplet size, droplet trajectory, and/or presence/absence of ink or fired droplets. Data from the sensor may be processed by the processor to determine if the printhead should be serviced to remove gas and/or prime nozzles. Accordingly, the processor may be configured to automatically initiate application of the sealing material and/or movement of ink through the supply conduit to the receiver compartment based on the sensor data. Alternatively, or in addition, the processor may be configured to initiate removal of gas from printheads at predefined intervals or based on instructions received from a user through a user interface. The processor further may be configured to control removal of the sealing material from the printhead and to coordinate this removal with movement of ink into nozzle supply conduit 64 after application of the sealing material.

Figure 3:
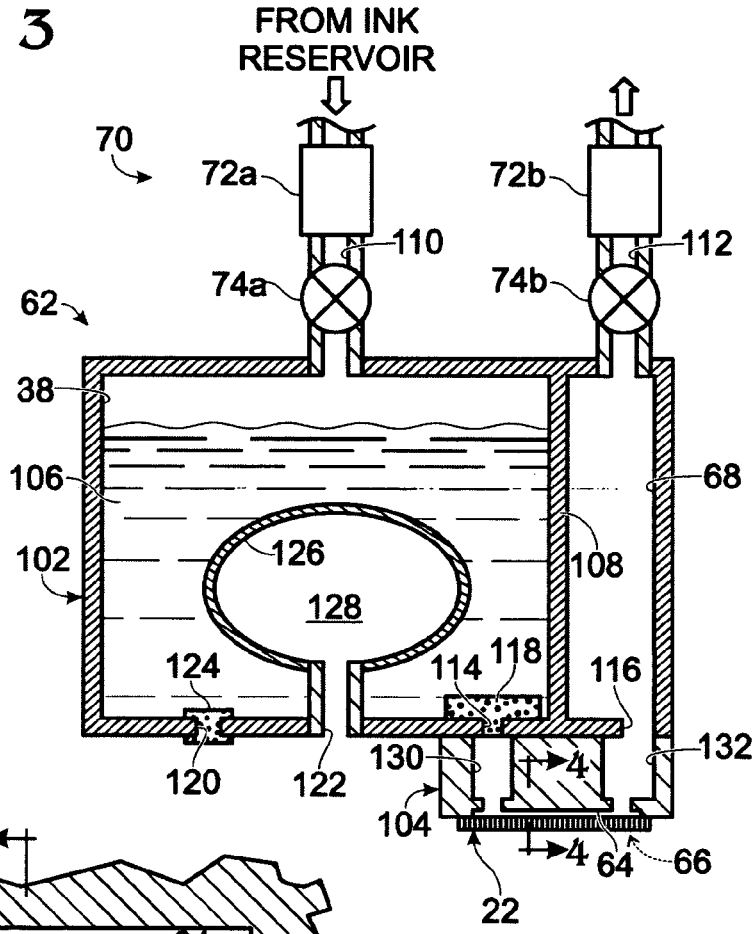
FIG. 3 is a sectional view of a printhead assembly from the printer of FIG. 1.

FIG. 3 shows a sectional view of selected aspects of printhead assembly 62 and pressure controller 70 from printer 20. Printhead assembly may include a body 102, at least one printhead 22, and a carrier 104 joining the printhead to the body.

Body 102 may define one or more compartments for holding fluid, such as ink or air. For example, in the present illustration, body 102 defines a supply chamber 38 configured to hold ink 106 to be fired from the printhead. Body 102 also may define a receiver compartment 68 separated from supply chamber 38 by internal wall 108. The body may be formed of any suitable material, such as a plastic, metal, glass, or ceramic, among others.

Body 102 may define a plurality of channels for movement of ink into and through the body and/or for regulating pressure in the body. For example, body 102 may define body channels 110, 112 for supplying ink to the body and between supply chamber 38 and receiver compartment 68. First body channel 110 may function as an inlet channel to receive ink from an ink reservoir. Second body channel 112 may function as an outlet (or inlet) channel for ink and/or gas and/or may be used for pressure regulation of the body. Each of body channels 110, 112, respectively, may be regulated by a pump 72*a*, 72*b* and/or at least one valve 74*a*, 74*b*. Each pump may be operable to create a positive or negative pressure in the body relative to the ambient pressure.

Body 102 also may define first and second openings 114, 116. First opening 114 may by a chamber outlet to permit ink to flow to printhead 22 and/or to receiver compartment 68 from supply chamber 38. First opening 114 may be covered by a filter 118 to remove particulates from the ink. Second opening 116 may be an inlet for receiver compartment 68, to permit ink and/or gas to travel into the receiver compartment. In some embodiments, second opening 116 may function as an inlet to carry ink to printhead 22 and/or supply chamber 38 from receiver compartment 68.

Body also may define an intake orifice 120 and a diaphragm orifice 122. Intake orifice 120 may be covered by a bubbler screen 124 configured to adjust the body pressure by permitting passage of external air into the body if the body pressure becomes too negative. Diaphragm orifice 122 may be attached to a diaphragm or deformable member 126 that forms an external gas compartment 128 of variable volume. Deformable member 126 may function, for example, to maintain a more constant pressure in supply chamber 38 as ink is removed from the supply chamber.

Carrier 104 may be configured to provide fluid communication between body 102 and printhead 22. Carrier 104 may define passages 130, 132 that extend between printhead 22 and body 102. In some examples, first passage 130 may function as an inlet to carry ink to printhead 22, and second passage 132 may function as an outlet to carry ink and/or gas from printhead 22 to receiver compartment 68. Ink flow between the first and second passages may be encouraged or discouraged according to the open or closed status of valve 74*b* and/or the pressure difference between the passages produced by pump(s) 72*a* and/or 72*b*. Carrier 104 may be formed of any suitable material, including ceramic, glass, plastic, silicon, metal, and/or the like.

Printhead 22 and/or carrier 104 may define a supply conduit 64 in fluid communication with the nozzles/orifices 66 of the printhead and providing fluid communication between passages 130, 132. Accordingly, ink entering supply conduit 64 from first passage 130 may be expelled from the nozzles and/or may travel to second passage 132. In some embodiments, the supply conduits may be a plurality of distinct conduits, for example, one or more distinct conduits for each column of nozzles.

Figure 4:
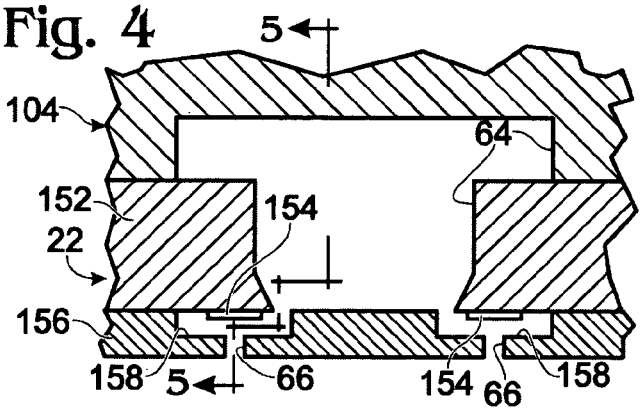
FIG. 4 is a fragmentary sectional view of a printhead and a carrier of the printhead assembly of FIG. 3, taken generally along line 4—4 of FIG. 3.

FIG. 4 shows a sectional view of printhead 22 and carrier 104. In this example, printhead 22 and carrier 104 cooperatively define supply conduit 64. Supply conduit 64 may extend lengthwise along the printhead, according to the arrangement of nozzles 66. In the present illustration, nozzles 66 are arranged in a pair of adjacent columns.

Printhead 22 may include a substrate 152, firing elements 154 formed on or in the substrate, and an orifice layer 156 connected to the substrate. The orifice layer and substrate may define a plurality of firing compartments 158 each including a firing element 154, such as a heater or a piezoelectric element, that can be selectively energized to expel ink from its respective nozzle 66. The substrate may be any suitable material, particularly a semiconductor, such as silicon, or an insulator, such as glass.

Figure 5:
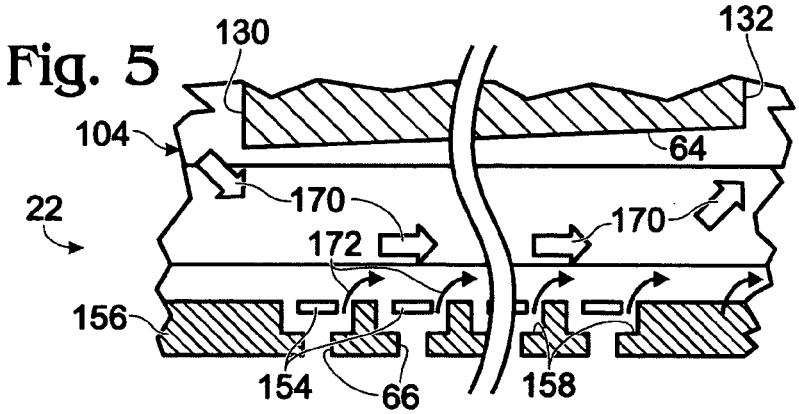
FIG. 5 is a fragmentary sectional view of the printhead and carrier of FIG. 4, taken generally along line 5—5 of FIG. 4.

FIG. 5 shows another sectional view of printhead 22 and carrier 104, taken through a column of nozzles 66. To simplify the presentation, a relatively small number of nozzles are shown. However, the printhead may have any suitable number of nozzles. In exemplary embodiments, each column of nozzles may have 150, 300, or 600 orifices.

FIG. 5 indicates a flow path 170 (open arrows) of ink through supply conduit 64. Ink may enter supply conduit 64 from first passage 130 of the carrier and exit the supply conduit at second passage 132 of the carrier. Flow of the ink may create a pressure drop directed inwardly from orifices 66 and firing compartments 158 to the printhead conduit, so that there is a net inward pressure at the orifices, shown at 172. This pressure drop may be created according to Bernoulli's principle, for example, by pushing ink through supply conduit 64 of smaller diameter at a greater speed than in flanking passageways.

FIGS. 6–10 show printhead configurations produced during performance of a method of removing gas from printhead 22. For simplification, only a single nozzle 66 and firing compartment 158 are shown in fluid communication with supply conduit 64.

Figure 6:
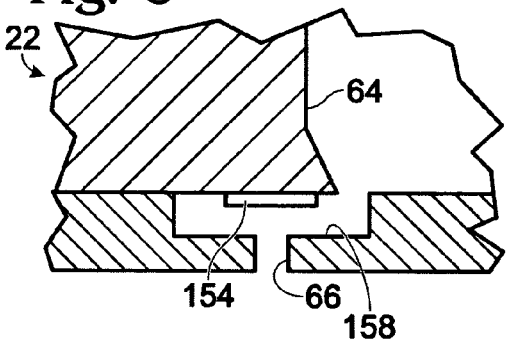
FIG. 6 is a fragmentary sectional view of the printhead of FIG. 5 in an unprimed configuration, in accordance with the present teachings.

FIG. 6 shows printhead 22 in an unprimed configuration. In this unprimed configuration, supply conduit 64, and particularly nozzle 66 and firing compartment 158, may be free of ink and filled with gas, generally air. The unprimed configuration may be the configuration of the printhead before its first use, that is, as sold to consumers. Alternatively, the unprimed configuration may be produced after the printhead has been used for printing, for example, by operating the printhead with a shortage of ink or as a desired condition of the printhead, such as produced during cleaning or the ink used. Alternatively, the printhead at this stage may be primed with ink, but may include trapped gas, such as pre-existing air bubbles, in one or more of the orifices, firing compartments, and/or in supply conduit 64, among others.

Figure 7:
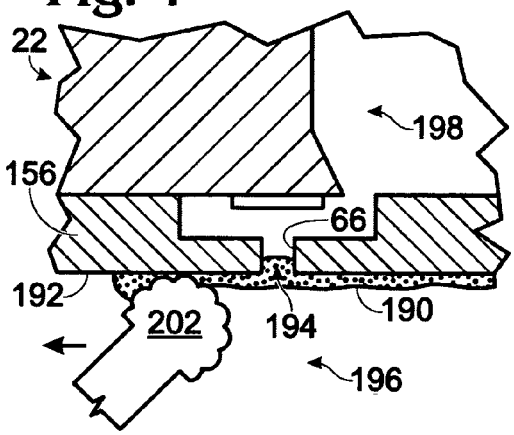
FIG. 7 is a fragmentary sectional view of the printhead of FIG. 5 during application of a sealing material to an external surface of the printhead, in accordance with the present teachings.

FIG. 7 shows printhead 22 during application of a sealing material 190 to an external surface 192 of the printhead. External surface 192 may be defined by orifice layer 156 or an orifice plate, among others. The sealing material may be applied to external surface 192 so that the sealing material covers and seals some or all of the orifices 66 of the printhead, shown at 194. Sealing an orifice, as used herein, means that the sealing material restricts passage of fluid through the orifice, for example, passage of external gas 196 into the printhead. Accordingly, a sealed orifice provides a hermetic restriction that separates internal gas 198 from external gas 196. Sealing material 190 may be a viscous liquid applied by contact of the printhead with an applicator 202. The applicator may be absorbent or nonabsorbent. In some examples, the applicator may include an elastomeric material, such as ethylene propylene diene monomer (EPDM) rubber.

Figure 8:
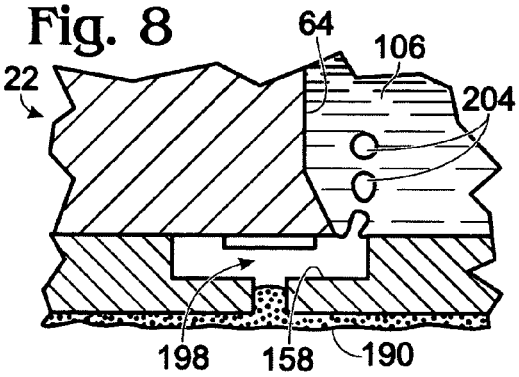
FIG. 8 is a fragmentary sectional view of the printhead of FIG. 5 during movement of ink through a supply conduit after application of the sealing material to an external surface of the printhead, in accordance with the present teachings.

FIG. 8 shows printhead 22 during movement of ink 106 through supply conduit 64 after application of sealing material 190 to seal the orifice. Movement of the ink may create a reduced pressure in the supply conduit so that internal gas 198 in firing compartment 158 enters supply conduit 64 as gas bubbles 204 and is replaced by ink 106 moving in a direction opposite to the gas bubbles.

Figure 9:
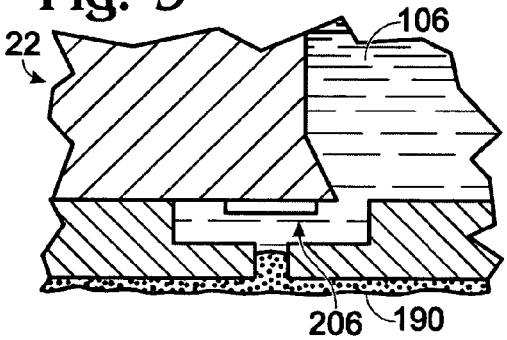
FIG. 9 is a fragmentary sectional view of the printhead of FIG. 5 in a primed condition after internal gas has been replaced substantially by ink as a result of movement of ink through a supply conduit after application of a sealing material, in accordance with the present teachings.

FIG. 9 shows printhead 22 in a primed condition after the internal gas has been replaced substantially by ink 106, shown at 206. Sealing material 190 now may be removed for operation of the primed printhead.

Figure 10:
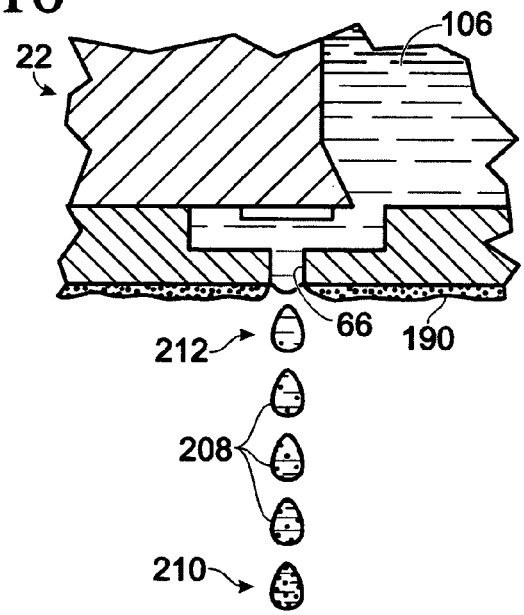
FIG. 10 is a fragmentary sectional view of the printhead of FIG. 5 firing droplets from one of its orifices after replacement of internal gas with ink, in accordance with the present teachings.

FIG. 10 shows printhead 22 firing droplets 208 from orifice 66. Such droplets initially may include a substantial amount of sealing material 190, shown at 210, which may decrease as additional droplets are fired, shown at 212. Alternatively, or in addition, sealing material may be removed from printhead 22 by a mechanical approach, such as wiping off the sealing material, and/or may be washed off by external application of a suitable solvent.

It is believed that the disclosure set forth above encompasses multiple distinct embodiments of the invention. While each of these embodiments has been disclosed in specific form, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

What is claimed is:

1. A method of removing gas from a printhead, comprising:

applying a sealing material including a viscous liquid to orifices of a printhead from external the printhead to restrict passage of fluid through the orifices;

moving ink through a printhead conduit disposed in fluid communication with the orifices to create an inward suction adjacent the orifices so that gas is displaced from adjacent the orifices; and wherein the printhead is included in a printhead assembly, the printhead assembly including a chamber and a receiver compartment disposed in fluid communication via the printhead conduit, the chamber being configured to supply the ink to the orifices for droplet firing, and wherein moving includes creating a pressure difference between the chamber and the receiver compartment to draw the ink through the printhead conduit from the chamber.

2. The method of claim 1, wherein applying a sealing material includes applying a sealing material that is more viscous than the ink.

3. The method of claim 1, wherein applying and moving are performed to prime the printhead before a first use of such printhead for printing.

4. The method of claim 1, wherein the sealing material and the ink are miscible, the method further comprising firing droplets from the orifices, the droplets including a mixture of the sealing material and the ink.

5. The method of claim 1, wherein applying includes placing a glycol adjacent the orifices.

6. The method of claim 1, wherein moving includes operating a peristaltic pump.

7. The method of claim 1, wherein applying disposes the sealing material adjacent a pre-existing gas bubble in the ink.

8. A method of removing gas from a printhead, comprising:

applying a sealing material including a viscous liquid to orifices of a printhead from external the printhead to restrict passage of fluid through the orifices;

moving ink through a printhead conduit disposed in fluid communication with the orifices to create an inward suction adjacent the orifices so that gas is displaced from adjacent the orifices; and sensing a property of ink droplets fired from at least a subset of the orifices, wherein applying and moving are performed automatically based on the property.

9. A printing system, comprising:

a printhead including orifices and a conduit disposed in fluid communication with the orifices, wherein the printhead is included in a printhead assembly, the printhead assembly including a chamber and a receiver compartment disposed in fluid communication via the conduit, the chamber being configured to supply the ink to the orifices for droplet firing;

an applicator configured to apply a sealing material including a viscous fluid to the orifices so that passage of fluid through the orifices is restricted; and a pressure controller configured to cause a pressure difference between the chamber and the receiver compartment to move ink from the chamber through the conduit after the sealing material is applied and to create an inward suction adjacent the orifices so that gas is displaced from adjacent the orifices.

10. The printing system of claim 9, wherein the printhead has an exterior surface, and wherein the applicator is configured to apply the sealing material adjacent the exterior surface.

11. The printing system of claim 10, wherein the applicator is configured to apply the sealing material by spreading the sealing material on the exterior surface of the printhead.

12. The printing system of claim 9, wherein the pressure controller includes a peristaltic pump.

13. The printing system of claim 9, further comprising a processor in communication with the applicator and the pressure controller, wherein the processor is configured to operate the applicator and the pressure controller.

14. The printing system of claim 9, further comprising an ink reservoir in fluid communication with the printhead and disposed off-axis from the printhead.

15. A program storage device readable by a processor, tangibly embodying a program of instructions executable by the processor to perform methods steps for removing gas from a printhead, the method steps comprising:

applying a sealing material including a viscous liquid to orifices of a printhead from external the printhead to restrict passage of fluid through the orifices; and moving ink through a printhead conduit disposed in fluid communication with the orifices to create an inward suction adjacent the orifices so that gas is displaced from adjacent the orifices;

wherein the printhead is included in a printhead assembly, the printhead assembly including a chamber and a receiver compartment disposed in fluid communication via the printhead conduit, the chamber being configured to supply the ink to the orifices for droplet firing, and wherein moving includes creating a pressure difference between the chamber and the receiver compartment to draw the ink through the printhead conduit from the chamber.

16. A printing system, comprising:

means for applying a sealing material including a viscous liquid to orifices of a printhead from external the printhead to restrict passage of fluid through the orifices; and means for moving ink through a printhead conduit disposed in fluid communication with the orifices to create an inward suction adjacent the orifices so that gas is displaced from adjacent the orifices;

wherein the printhead is included in a printhead assembly, the printhead assembly including a chamber and a receiver compartment disposed in fluid communication via the printhead conduit, the chamber being configured to supply the ink to the orifices for droplet firing, and wherein the means for moving ink creates a pressure difference between the chamber and the receiver compartment to draw the ink through the printhead conduit from the chamber.

17. The printing system of claim 16, wherein means for applying a sealing material including means for applying a sealing material that is more viscous than the ink.

* * * * *

UNITED STATES PATENT AND TRADEMARK OFFICE

CERTIFICATE OF CORRECTION

PATENT NO. : 7,097,274 B2
APPLICATION NO. : 10/769422
DATED : August 29, 2006
INVENTOR(S) : Hal Mantooth et al.

It is certified that error appears in the above-identified patent and that said Letters Patent is hereby corrected as shown below:

On the Title page, Item (75), in "Inventors", delete "Beaverton" and insert -- Portland --, therefor.

On the Title page, Item (75), in "Inventors", after "(US)" insert -- Ashley Childs, Corvallis, OR (US); --.

On the Title page, Item (75), in "Inventors", after "(US)" insert -- Daniel Stirn, Albany, OR (US) --.

Signed and Sealed this

Third Day of February, 2009

John Doll

JOHN DOLL
*Acting Director of the United States Patent and Trademark Office*